US008120270B2

(12) United States Patent
Rudolph

(10) Patent No.: US 8,120,270 B2
(45) Date of Patent: Feb. 21, 2012

(54) CIRCUIT ARRANGEMENT AND METHOD FOR OPERATING A DISCHARGE LAMP WITH PREHEATABLE ELECTRODES

(75) Inventor: Bernd Rudolph, Forstern (DE)

(73) Assignee: OSRAM AG, Müchen (DE)

( * ) Notice: Subject to any disclaimer, the term of this patent is extended or adjusted under 35 U.S.C. 154(b) by 283 days.

(21) Appl. No.: 12/515,948

(22) PCT Filed: Nov. 22, 2006

(86) PCT No.: PCT/EP2006/068749

§ 371 (c)(1),
(2), (4) Date: May 21, 2009

(87) PCT Pub. No.: WO2008/061559

PCT Pub. Date: May 29, 2008

(65) Prior Publication Data

US 2010/0052541 A1 Mar. 4, 2010

(51) Int. Cl.
*H05B 41/16* (2006.01)
*H05B 41/24* (2006.01)

(52) U.S. Cl. ..... 315/247; 315/291; 315/307; 315/308

(58) Field of Classification Search ..... None
See application file for complete search history.

(56) References Cited

U.S. PATENT DOCUMENTS

| | | | | |
|---|---|---|---|---|
| 6,051,940 | A * | 4/2000 | Arun | 315/307 |
| 2005/0093477 | A1 | 5/2005 | Shi | |
| 2007/0108915 | A1 * | 5/2007 | Ribarich | 315/247 |

FOREIGN PATENT DOCUMENTS

| | | |
|---|---|---|
| WO | WO 99/32953 | 7/1999 |
| WO | WO 99/56505 | 11/1999 |

* cited by examiner

*Primary Examiner* — Anh Tran
(74) *Attorney, Agent, or Firm* — Cozen O'Connor

(57) ABSTRACT

A circuit arrangement for operating a discharge lamp (LA) with preheatable electrodes comprising: an input terminal for applying an input voltage ($U_E$); an output terminal for providing an output voltage ($U_A$) to a lamp generator (LG) for operating the discharge lamp (LA); a switching unit (14) for power factor correction which is coupled between the input terminal and the output terminal; a monitoring apparatus (20) which is adapted to switch off the lamp generator (LG) in the event of the presence of at least one switch-off criterion; an integrated circuit (16), which is adapted to drive the switching unit (14) for power factor correction, the integrated circuit (16) having a disable input; and a blocking apparatus (18), which is adapted to generate a blocking signal at its output when the lamp generator (LG) is switched off, the output of the blocking apparatus (18) being coupled to the disable input of the integrated circuit (16).

8 Claims, 1 Drawing Sheet

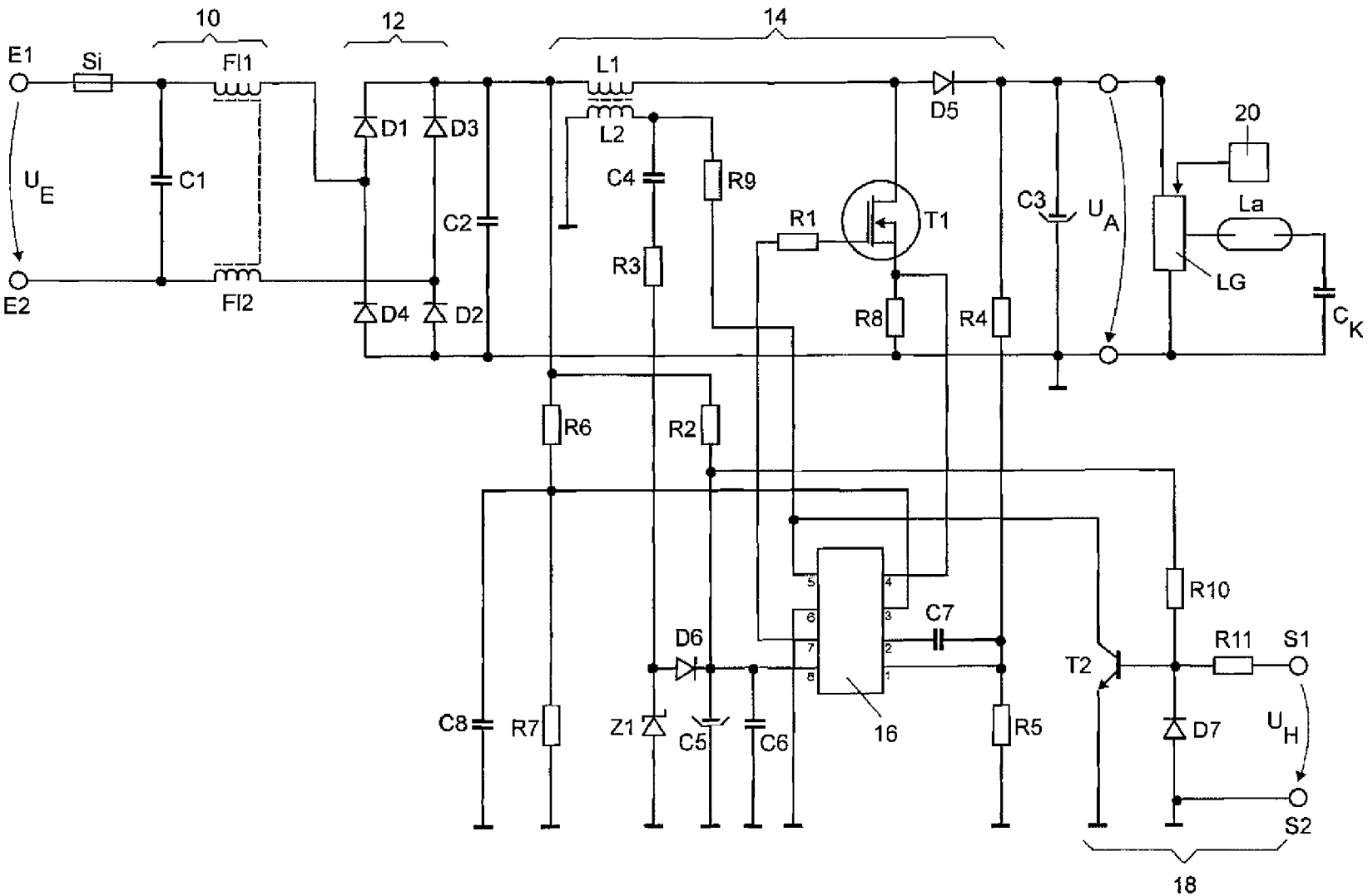
E1
E2
$U_E$
Si
C1
Fl1
Fl2
10
D1
D2
D3
D4
C2
12
L1
L2
C4
R3
R9
14
D5
T1
R1
R8
R4
C3
$U_A$
20
La
LG
$C_K$
R6
R2
R7
C8
Z1
D6
C5
C6
16
C7
R5
T2
R10
R11
D7
S1
S2
$U_H$
18

CIRCUIT ARRANGEMENT AND METHOD FOR OPERATING A DISCHARGE LAMP WITH PREHEATABLE ELECTRODES

RELATED APPLICATIONS

This is a U.S. national stage of application No. PCT/EP2006/068749 filed Nov. 22, 2006.

FIELD OF THE INVENTION

The present invention relates to a circuit arrangement for operating a discharge lamp with preheatable electrodes with an input terminal for applying an input voltage, an output terminal for providing an output voltage to a lamp generator for operating the discharge lamp, a switching unit for power factor correction which is coupled between the input terminal and the output terminal, a monitoring apparatus which is designed to switch off the lamp generator in the event of the presence of at least one switch-off criterion and an integrated circuit, which is designed to drive the switching unit for power factor correction, the integrated circuit having a disable input.

BACKGROUND OF THE INVENTION

A fault event of a circuit arrangement for operating a discharge lamp with preheatable electrodes generally occurs directly at the lamp generator, for example when the lamp is removed, in the case of a lamp which does not start or at EoL (End of Life). Once a fault event has been detected, the lamp generator then remains switched off until the normal state is reproduced. In this case, one or more electrodes of the discharge lamp are generally used for the purpose of obtaining information on the proper connection of the discharge lamp to the circuit arrangement. If the discharge lamp is replaced, a circuit is interrupted which has maintained this switch-off state. This provides the possibility for the discharge lamp to be restarted.

The switching unit provided in a generic circuit arrangement for implementing power factor correction is often realized by means of a standard PFC (Power Factor Correction) IC (Integrated Circuit), for example using the L6562 by STM. In order to avoid intermittent operation of the switching unit for power factor correction when the lamp generator is switched off, measures therefore need to be taken to ensure that this switching unit remains switched off until the normal state is reproduced even when its activity is resumed.

One solution which could consist in routing the startup circuit of the switching unit for power factor correction via at least one lamp filament is nevertheless an option since otherwise the so-called active "pull down" of the power switch driven by the switching unit for power factor correction, which power switch is generally a MOSFET, could not be ensured under all operating conditions and the risk of destruction of this power switch would arise.

In the prior art, i.e. in a generic circuit arrangement, the integrated circuit measures the input voltage and the output voltage. If the values are in a predetermined value range, a start sequence is triggered. Off load, i.e. when a lamp is not inserted, the output voltage UA is in this case very high. During intermittent operation, voltages of up to 480 V were measured across the lamp terminals. The circuit arrangement therefore falls under a safety class which entails complicated precautions for preventing accidents. The event of a predeterminable threshold value for the output voltage being exceeded is established by the integrated circuit, which then switches off. As a result, the output voltage is reduced again, which in turn is established by the integrated circuit and results in a renewed start sequence being triggered. This procedure is repeated although no lamp has been inserted, and this results in heavy loading of the components involved.

SUMMARY OF THE INVENTION

One object of the present invention is therefore to develop a generic circuit arrangement and/or a generic method in order to avoid intermittent operation of the switching unit for power factor correction with minimum complexity in terms of circuitry and to ensure reliable activation of the switching unit for power factor correction within desired periods of time.

The above object can be achieved if a blocking apparatus is provided which is coupled to the lamp generator in accordance with the master/slave principle, with the lamp generator representing the master and the blocking apparatus representing the slave. That is to say that as soon as the lamp generator is switched off as a result of the occurrence of a fault event, this automatically results in the blocking apparatus generating a blocking signal, the blocking signal being coupled to the disable input of the integrated circuit. As a result, the integrated circuit is switched off, driving of the switching unit for power factor correction and therefore intermittent operation being suppressed. However, as soon as it is identified that the fault event has been eliminated, i.e. the lamp generator is back in operation, the outputting of a blocking signal by the blocking apparatus is stopped, as a result of which the switching unit for power factor correction resumes operation. This ensures in a very simple manner that the switching unit for power factor correction is in operation as long as the lamp generator is in operation and is switched off as soon as the lamp generator is switched off.

As a result of a circuit arrangement according to an embodiment of the invention, intermittent operation and associated loading of the components of the entire switching unit for power factor correction are avoided in the event of a lamp fault. Secondly, restarting of the circuit arrangement including the switching unit for power factor correction after a lamp replacement is possible without any problems, i.e. without further intervention by a user. Particularly advantageous here is the circumstance in which now only voltages of approximately 325 V are produced at the lamp terminals in the case of a circuit arrangement according to the invention. A different safety class which is associated with much fewer conditions and therefore much less complexity is therefore appropriate.

A preferred embodiment of a circuit arrangement according to the invention is characterized by the fact that the blocking apparatus is designed to generate an enable signal at its output when the lamp generator is switched on. This means that the integrated circuit is blocked and therefore no driving of the switching unit for power factor correction takes place as long as the lamp generator is switched off. Conversely, as long as the lamp generator is switched on an enable signal is generated, i.e. the integrated circuit instructs the switching unit for implementing the power factor correction to be correspondingly driven.

Provision is preferably furthermore made for the blocking apparatus to comprise an electronic switch, which has a control electrode, the control electrode firstly being connected to a deactivation signal, which is designed to deactivate the blocking apparatus in the switched-on state of the lamp generator, and an activation signal, which is designed to activate the blocking apparatus in the switched-off state of the lamp generator. In this case, it is preferred if the activation signal has been correlated with a voltage of the circuit arrangement which is sufficient for switching on the electronic switch without the presence of the deactivation signal, the deactivation signal having been correlated with a voltage which has, only in the switched-on state of the lamp generator, an amplitude which is sufficient for blocking the electronic switch despite the presence of the activation signal. This measure avoids complex gate logic since the activation signal and the deactivation signal can both be applied to the control electrode of the electronic switch, with the deactivation signal, if it is present in this case, prevailing over the activation signal.

In a preferred development, the lamp generator has a trapezoidal capacitor, the electronic switch being a bipolar transistor, the activation signal having been correlated with the input voltage, and the deactivation signal having been correlated with the voltage across the trapezoidal capacitor, in particular with the voltage rate of rise du/dt. This provides the advantage that the generation of the activation signal and of the deactivation signal can be performed virtually without any additional components, i.e. without any additional costs and without any additional population complexity.

Particularly preferably, the electronic switch of the blocking apparatus is in the form of a transistor, whose reference electrode is connected to ground, the deactivation signal representing a first voltage, and the activation signal representing a second voltage, the second voltage being designed to switch the transistor on without the presence of the first voltage, and the first voltage being designed to switch the transistor off despite the presence of the second voltage.

In this case, it is furthermore preferred if the first and the second voltage are coupled to the control electrode of the transistor via a respective nonreactive resistor.

The preferred embodiments proposed with reference to the circuit arrangement according to the invention and advantages thereof apply, where appropriate, correspondingly to the method according to the invention.

BRIEF DESCRIPTION OF THE DRAWING(S)

An exemplary embodiment will now be described in more detail below with reference to the attached drawing. Said drawing shows a schematic illustration of the design of an exemplary embodiment of a circuit arrangement according to the invention.

PREFERRED EMBODIMENT OF THE INVENTION

FIG. 1 shows a schematic illustration of an exemplary embodiment of a circuit arrangement according to the invention. In this case, an input voltage $U_E$, in this case the system voltage, is applied between the input terminals E1, E2. There then follows a fuse Fi and a unit 10, which comprises a capacitor C1 and two coils F11 and F12 which are coupled to one another, and is used for radio interference suppression. There then follows a rectifier 12, which comprises the diodes D1, D2, D3 and D4. The rectified voltage is provided at a capacitor C2 to a step-up converter 14, which comprises a step-up converter inductor L1, a step-up converter diode D5 and a step-up converter switch T1. The output voltage $U_A$ of the step-up converter 14 is provided at a capacitor C3 in particular as the so-called intermediate circuit voltage to the lamp generator LG. The term lamp generator LG is understood to mean the combination of the inverter, in particular in the form of a half-bridge or full-bridge circuit, and a load circuit. The lamp La is coupled to the lamp generator and is coupled to the reference potential via a coupling capacitor $C_K$.

For power factor correction, an integrated circuit 16, which drives the switch T1 of the step-up converter 14 for implementing power factor correction via its pin 7 and the nonreactive resistor R1, is used in addition to the step-up converter 14. The integrated circuit 16 may be, for example, a module L6562 by STM. The pin 6 of the integrated circuit 16 is connected to a reference potential, in this case ground. The voltage is supplied to the integrated circuit 16 via the pin 8, with the startup current being supplied via the nonreactive resistor R2, while the continuous-operation voltage is supplied with the involvement of the components C4, R3, D6, Z1, C5 and C6 and an inductance L2, which forms a transformer together with the inductance L1. The output voltage $U_A$ is measured with the involvement of the components R4, R5 and C7 via the pins 1 and 2 of the integrated circuit 16, with an integrator being formed by the wiring of the pins 1 and 2. The input voltage $U_E$ is measured at the pin 3 with the involvement of the components R6, R7 and C8. The current through the switch T1 is monitored at the pin 4 via the voltage drop across the nonreactive resistor R8. The pin 5 of the integrated circuit 16 has a dual function: the identification of the demagnetization of the storage inductor L1 via the auxiliary winding L2 and the so-called disable input. In the normal state, i.e. when there is no fault event, a voltage potential which corresponds to an enable signal is present at the pin 5 via a nonreactive resistor R9. This ensures that the integrated circuit 16 drives the switch T1 of the step-up converter 14 for implementing power factor correction via the pin 7. However, as soon as a fault event has been established in the lamp generator LG, a blocking apparatus 18 ensures that the potential of the pin 5 of the integrated circuit 16 is changed so as to result in blocking of the driving of the switch T1 via the pin 7 of the integrated circuit 16. The blocking apparatus 18 comprises a switch T2, two nonreactive resistors R10, R11, a diode D7 and terminals S1, S2, to which a negative auxiliary voltage $U_H$ is applied. As long as the negative auxiliary voltage $U_H$ which is obtained, for example, from a trapezoidal capacitor of the lamp generator LG is present, the transistor T2 is turned off, with the result that a signal is present at the pin 5 of the integrated circuit 16 via the nonreactive resistor R9, which signal, as has been mentioned, results in the desired driving of the switch T1 of the step-up converter 14 for implementing power factor correction. As soon as the lamp generator LG is deactivated in the event of a fault, i.e. when at least one switch-off criterion is established by a monitoring apparatus 20, the signal $U_H$ for deactivating the blocking apparatus 18 is inapplicable. Instead, an activation signal is now applied to the switch T2 via the nonreactive resistors R2 and R10, which signal results in the switch T2 being switched on, with the result that virtually the reference potential, in this case ground, is present at the pin 5, with this reference potential corresponding to an active low. This means that the integrated circuit 16 ends the driving of the switch T1 of the step-up converter 14 via the pin 7.

As soon as the monitoring apparatus 20 has established that the at least one switch-off criterion for the lamp generator LG is no longer present, the lamp generator LG is brought back into operation. As a result, the auxiliary voltage $U_H$ is again produced, and this voltage results in the switch T2 being turned off. As a result, the integrated circuit 16 resumes its operation and drives the switch T1 for implementing power factor correction via the pin 7.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A circuit arrangement for operating a discharge lamp with preheatable electrodes comprising:

an input terminal for applying an input voltage;

an output terminal for providing an output voltage to a lamp generator for operating the discharge lamp;

a switching unit for power factor correction which is coupled between the input terminal and the output terminal;

a monitoring apparatus which is adapted to switch off the lamp generator in the event of the presence of at least one switch-off criterion;

an integrated circuit, which is adapted to drive the switching unit for power factor correction, the integrated circuit having a disable input; and a blocking apparatus, which is adapted to generate a blocking signal at its output when the lamp generator is switched off, the output of the blocking apparatus being coupled to the disable input of the integrated circuit, wherein the lamp generator has a trapezoidal capacitor, and the blocking apparatus generates the blocking signal based on a characteristic of a voltage at the trapezoidal capacitor.

2. The circuit arrangement as claimed in claim 1, wherein the blocking apparatus is adapted to generate an enable signal at its output when the lamp generator is switched on.

3. The circuit arrangement as claimed in claim 1, wherein the blocking apparatus comprises an electronic switch, which has a control electrode, the control electrode firstly being connected to a deactivation signal, which is adapted to deactivate the blocking apparatus in the switched-on state of the lamp generator, and an activation signal, which is adapted to activate the blocking apparatus in the switched-off state of the lamp generator.

4. The circuit arrangement as claimed in claim 3, wherein the activation signal has been correlated with a voltage of the circuit arrangement which is sufficient for switching on the electronic switch without the presence of the deactivation signal, and the deactivation signal having been correlated with a voltage which has, only in the switched-on state of the lamp generator, an amplitude which is sufficient for blocking the electronic switch despite the presence of the activation signal.

5. The circuit arrangement as claimed in claim 3, wherein the electronic switch is a bipolar transistor, the activation signal having been correlated with the input voltage, and the deactivation signal having been correlated with the voltage rate of rise du/dt at the trapezoidal capacitor.

6. The circuit arrangement as claimed in claim 3, wherein the electronic switch is a transistor which includes a reference electrode that is connected to ground, the deactivation signal representing a first voltage, and the activation signal representing a second voltage, the second voltage being adapted to switch the transistor on without the presence of the first voltage, and the first voltage being adapted to switch the transistor off despite the presence of the second voltage.

7. The circuit arrangement as claimed in claim 6, wherein the first and the second voltage are coupled to the control electrode of the transistor via a respective nonreactive resistor.

8. A method for operating a discharge lamp with preheatable electrodes using a circuit arrangement with an input terminal for applying an input voltage, an output terminal for providing an output voltage to a lamp generator for operating the discharge lamp, a switching unit for power factor correction which is coupled between the input terminal and the output terminal, a monitoring apparatus, which is adapted to switch off the lamp generator in the event of the presence of a switch-off criterion, and an integrated circuit, which is adapted to drive the switching unit for power factor correction, the integrated circuit having a disable input, wherein the method comprises the steps of:

a) producing a blocking signal when the lamp generator is switched off based on a characteristic of a voltage at a trapezoidal capacitor of the lamp generator; and b) coupling the blocking signal to the disable input of the integrated circuit for deactivating the integrated circuit.

* * * * *